US007618293B2

(12) United States Patent
Wu

(10) Patent No.: US 7,618,293 B2
(45) **Date of Patent: *Nov. 17, 2009**

(54) EXTENSION TO ELECTRICAL CONNECTOR WITH IMPROVED HOUSING STRUCTURES

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/151,651

(22) Filed: May 8, 2008

(65) Prior Publication Data

US 2009/0117784 A1 May 7, 2009

Related U.S. Application Data

(63) Continuation-in-part of application No. 11/982,660, filed on Nov. 2, 2007, now Pat. No. 7,422,488.

(51) Int. Cl.
*H01R 24/00* (2006.01)

(52) U.S. Cl. ..... 439/660; 439/493

(58) Field of Classification Search ..... 439/626, 439/357, 108, 607.17, 660, 493, 604
See application file for complete search history.

(56) References Cited

U.S. PATENT DOCUMENTS

| | | | | |
|---|---|---|---|---|
| 7,021,971 | B2 | 4/2006 | Chou et al. | |
| 7,104,848 | B1 | 9/2006 | Chou et al. | |
| 7,108,560 | B1 | 9/2006 | Chou et al. | |
| 7,125,287 | B1 | 10/2006 | Chou et al. | |
| 7,134,884 | B2 | 11/2006 | Wang et al. | |
| 7,422,488 | B1 * | 9/2008 | Wu | 439/676 |
| 7,534,141 | B1 * | 5/2009 | Wu | 439/660 |
| 7,534,143 | B1 * | 5/2009 | Tsao et al. | 439/497 |
| 2006/0025015 | A1 | 2/2006 | Hu et al. | |

(Continued)

FOREIGN PATENT DOCUMENTS

| | | | |
|---|---|---|---|
| CN | 2891389 | Y | 4/2007 |

(Continued)

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

An electrical connector (100) comprises a first housing piece (2) defining a tongue portion (22) defining a mating surface (221) thereon, a first set of contacts (3) immovably held in the first housing piece, a second housing piece (9) assembled to the first housing piece to form an insulative housing, a second set of contacts (4) immovably held in the second housing piece, and a plurality of first and second wires (51, 52) electrically connecting with the first and second sets of the contacts, and at least two second wires connected to a single second contact. Each first contact comprises a nonelastic contact portion (36) exposed on the mating surface of the tongue portion. The second set of contacts comprises at least one pair of differential contacts (41) immovably held in the second housing piece for transferring high-speed signals. Each of the second set of contacts comprises an elastic contact portion (45) exposed on the mating surface of the tongue portion of the first housing piece to be located behind the nonelastic contact portion along the front-to-back direction.

15 Claims, 11 Drawing Sheets

U.S. PATENT DOCUMENTS

2006/0261474 A1 11/2006 Jiang et al.
2006/0286865 A1 12/2006 Chou et al.
2006/0294272 A1 12/2006 Chou et al.
2009/0117784 A1* 5/2009 Wu ..... 439/660
2009/0117785 A1* 5/2009 Wu ..... 439/668
2009/0130906 A1* 5/2009 Tsao et al. ..... 439/626

FOREIGN PATENT DOCUMENTS

CN 2922162 Y 7/2007
TW M306723 2/2007

* cited by examiner

EXTENSION TO ELECTRICAL CONNECTOR WITH IMPROVED HOUSING STRUCTURES

CROSS-REFERENCE TO RELATED APPLICATIONS

This application is related to U.S. patent application Ser. No. 11/818,100, filed on Jun. 13, 2007 and entitled "EXTENSION TO UNIVERSAL SERIAL BUS CONNECOTR WITH IMPROVED COTNACT ARRANGEMENT", and a copending application entitled "EXTENSION TO ELECTRICAL CONNECTOR WITH IMPROVED CABLE TERMINATION", both of which have the same assignee as the present invention; and is a Continued-in-Part (CIP) of U.S. patent application Ser. No. 11/982,660, filed on Nov. 2, 2007 now U.S. Pat. No. 7,422,488 and entitled "EXTENSION TO ELECTRICAL CONNECTOR WITH IMPROVED CONTACT ARRANGEMENT AND METHOD OF ASSEMBLING THE SAME", which has the same inventor and assignee as the present invention.

BACKGROUND OF THE INVENTION

1. Field of the Invention

The present invention relates to an electrical connector, more particularly to an electrical connector compatible to standard Universal Serial Bus (USB) 2.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for, portability and high data transmitting efficiency is much desirable. Such kind electrical connectors are disclosed in a U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are held on the top tongue portion and additional contacts are accommodated on the lower tongue portion of the receptacle. With contrast with existing USB type-A receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent are viable options to add so many contacts. As fully discussed above, the receptacle equipped with two tongue portions or plug and receptacle both with a longer length are also clumsiness. That is not very perfect from a portable and small size standpoint.

BRIEF SUMMARY OF THE INVENTION

Accordingly, an object of the present invention is to provide an electrical connector with low profile and lower cost.

In order to achieve the above-mentioned object, an electrical connector comprises a first housing piece defining a tongue portion defining a mating surface thereon, a first set of contacts immovably held in the first housing piece, a second housing piece assembled to the first housing piece to form an insulative housing, a second set of contacts immovably held in the second housing piece, and a plurality of first and second wires electrically connecting with the first and second sets of the contacts, and at least two second wires connected to a single second contact. Each first contact comprises a nonelastic contact portion exposed on the mating surface of the tongue portion. The second set of contacts comprises at least one pair of differential contacts immovably held in the second housing piece for transferring high-speed signals. Each of the second set of contacts comprises an elastic contact portion exposed on the mating surface of the tongue portion of the first housing piece to be located behind the nonelastic contact portion along the front-to-back direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
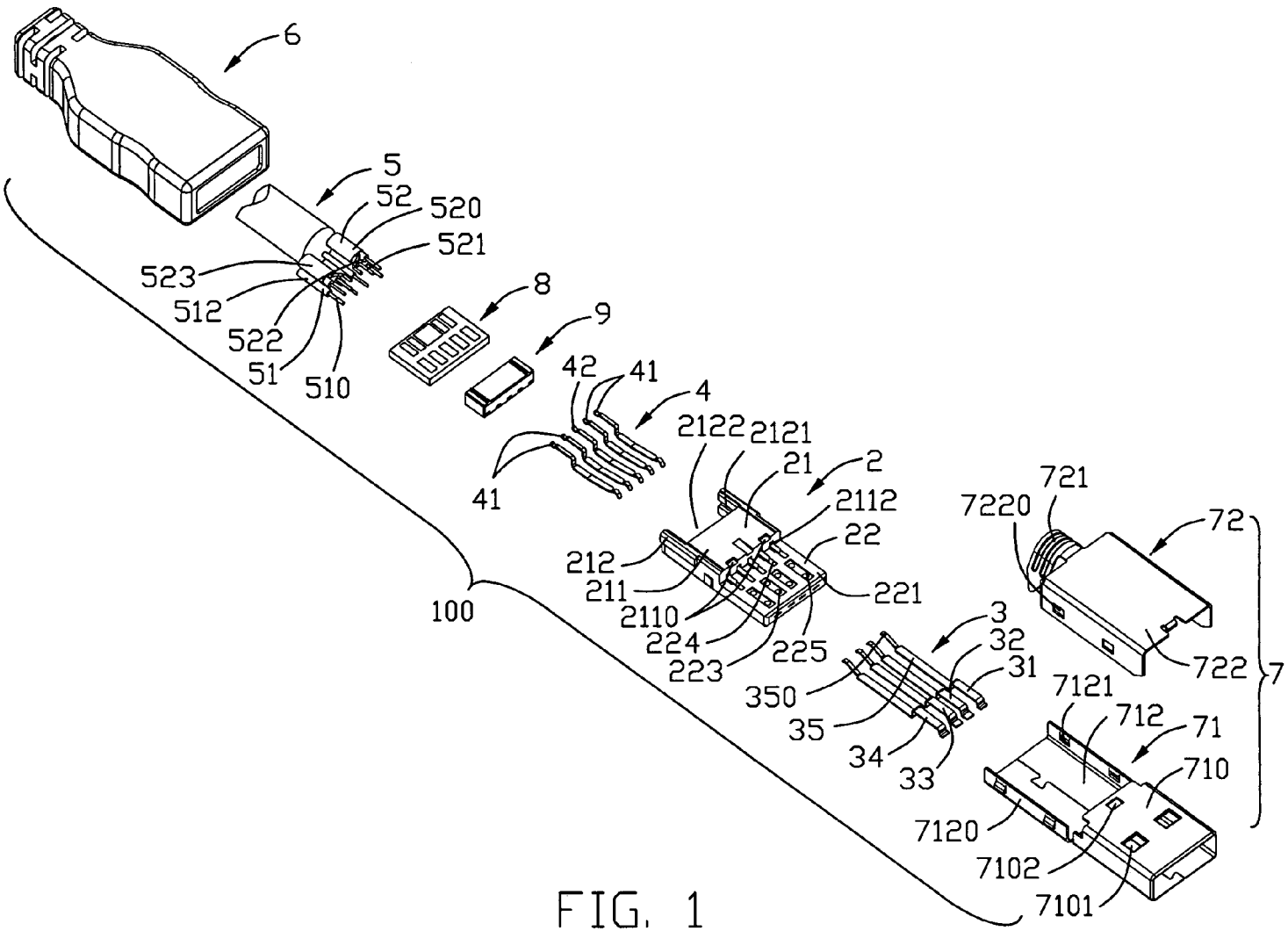
FIG. 1 is an exploded, perspective view of an extension to an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Figure 2:
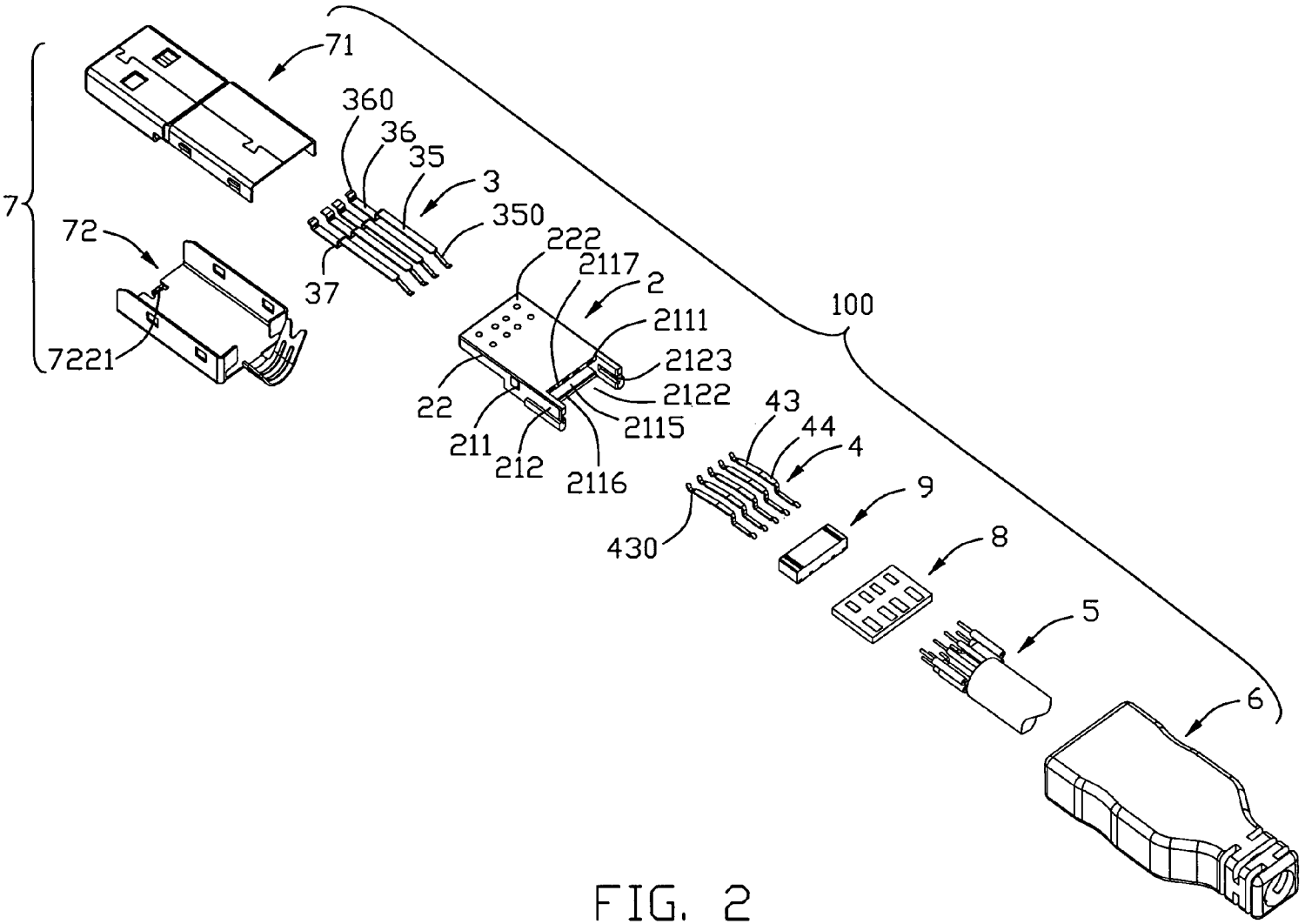
FIG. 2 is a view similar to FIG. 1, but viewed from a different aspect.

Referring to FIGS. 1-2, an extension to an electrical connector 100, that is a USB plug 100, according to the present invention is disclosed. The extension to USB plug 100 comprises an insulative housing 2 which has an insulative base portion 21 and an insulative tongue portion 22 extending from the insulative base portion 21 in a front-to-rear direction, an insert 9 assembled to the insulative housing 2, a first set of contacts 3 and a second set of contacts 4 supported in the insulative housing 2 and the insert 9, and a metal shell 7 enclosing the insulative housing 2 and the contacts 3, 4. Besides, a cable 5 having first and second sets of wires 51, 52, and a substrate 8 is provided to electrically connect with the contacts 3, 4 at a front end thereof and connect with the wires 51, 52 at opposite rear end thereof. In order to provide a strong structure of the extension to USB plug 100, an outer insulative cover 6 is over molded on a rear section of the insulative housing 2 together with the metal shell 7, the substrate 8 and the cable 5. In the preferred embodiment, the insulative housing 2 and the insert 9 are served as first and second housing pieces 2, 9. The outer insulative cover 6 is adapted for being grasped by a user when the extension to USB plug 100 is used. Detail description of these elements and their relationship and other elements formed thereon will be detailed below.

Figure 3:
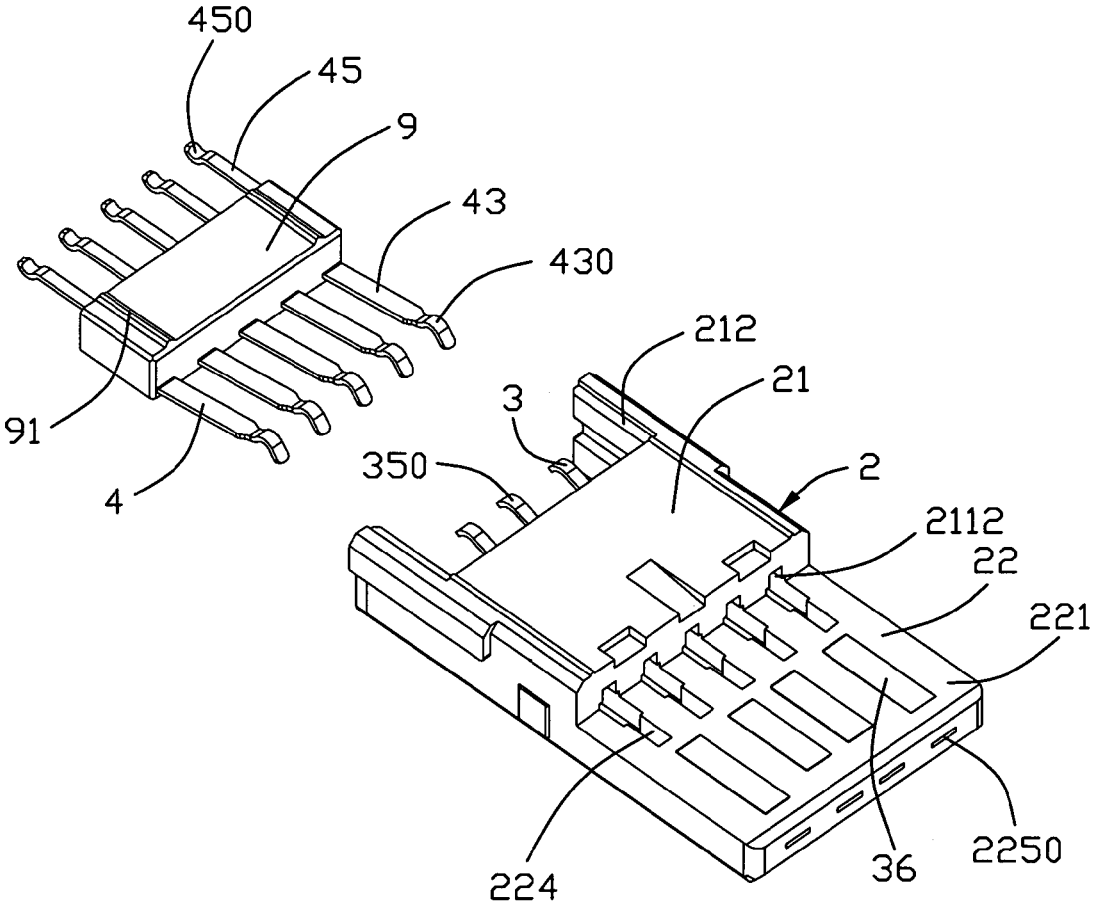
FIGS. 3-7 are partially assembled views of the extension to an electrical connector of FIGS. 1-2.
Figure 4:
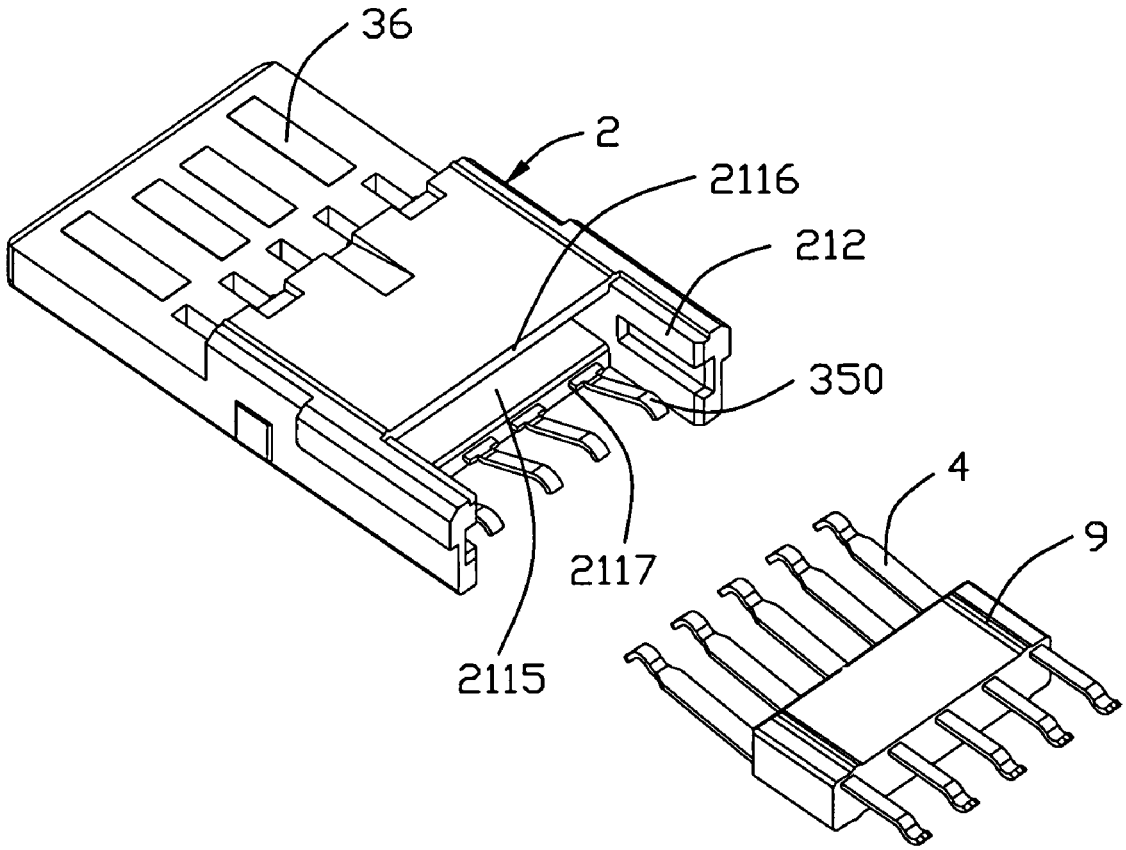
Figure 5:
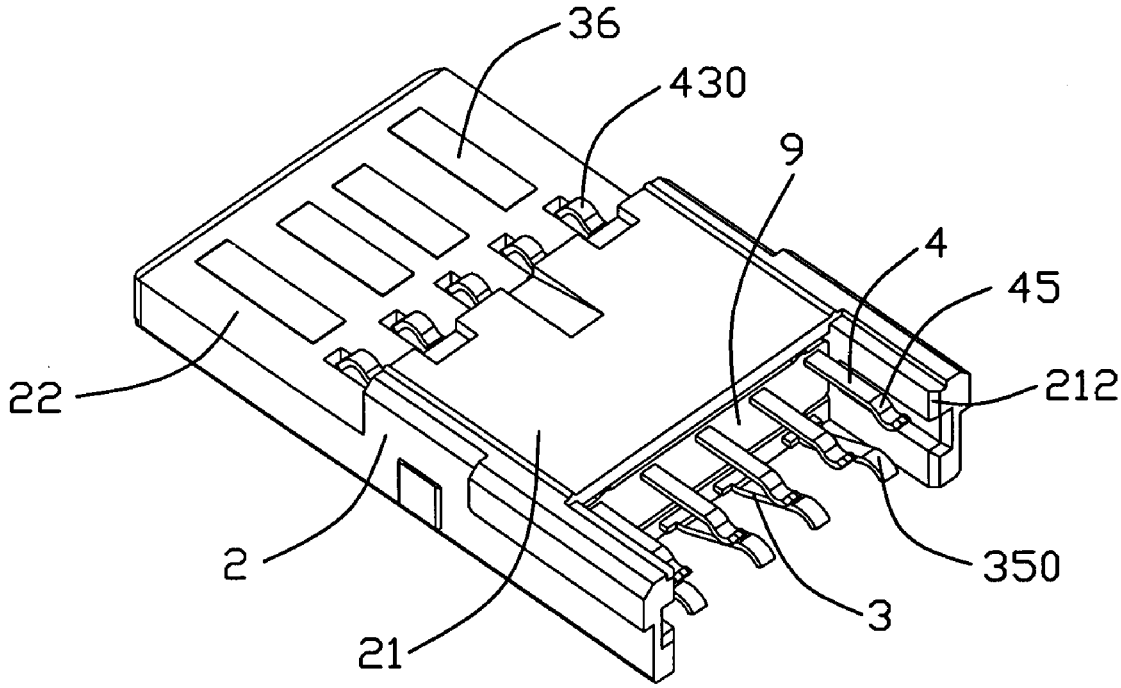

Referring to FIGS. 1-3, the base portion 21 and the tongue portion 22 of the insulative housing 2 are integrally injecting molded as a unit one piece. The base portion 21 comprises a front engaging section 211 for engaging with the metal shell 7 and a rear terminating section 212 for the termination between the substrate 8 and the contacts 3, 4. The engaging section 211 defines a plurality of cutouts 2110 in upper surface thereof adjacent to a front surface thereof for engaging with the metal shell 7. The rear termination section 212 is of U-shape and comprises a pair of lateral walls 2121 rearward extending from opposite sides of the engaging section 211 to define a terminating space 2122 for exposing tail portions of the first and second sets of contacts 3, 4 and receiving the substrate 8. Each lateral wall 2121 defines a guiding slot 2123 recessed outwardly from inner surface thereof for guiding insertion of the substrate 8 into the terminating space 2122. The engaging section 211 defines an accommodating space 2115 recessed forwardly from rear surface thereof to communicate with the terminating space 2122. Therefore, the engaging section 211 is divided to form opposite upper and lower flat boards 2116, 2117. Four first passageways 2111 define through the lower flat board 2117 and five second passageways 2112 define through the engaging section 211 to communicate with the accommodating space 2115. Each first passageway 2111 is wider than each second passageway 2112.

The tongue portion 22 has a first supporting surface 221 lower than the upper surface of the base portion 21 and opposite second supporting surface 222 coplanar with lower surface of the base portion 22. Four first passages 223 and five second passages 224 respectively recess downwardly from the first supporting surface 221 of the tongue portion 22 and are arranged in a front row and communicating with the first passageways 2111 in height direction and a rear row aligning with the second passageways 2112 in front-to-back direction. Four deeper front recesses 225 are recessed downward toward the second supporting surface 222 and communicate with corresponding first passages 223. Four slits 2250 recess inwardly from the front surface of the tongue portion 22 to communicate with the recesses 225 with wider width than that of the recess 225.

Referring to FIGS. 1-2 in conjunction with FIGS. 3-7, the first set of contacts 3 include four plug conductive contacts designated with numeral 31, 32, 33 and 34. The four first contacts 3 are insertmolded with the insulative housing 2 when forming the insulative housing 2. Thus, the insulative housing 2 has better intensity and assembly time is decreased. Each first contact 3 comprises a rear flat body section 35 received in the first passageways 2111 with rear curved tail section 350 thereof exposed in the terminating space 2122, a flat contacting section 36 embedded in the first passage 223 and coplanar with the first supporting surface 221, a vertical connecting section 37 connecting with the body section 35 and the contacting section 36 and embedded in the tongue portion 22, and a front L-shape tip end 360 embedded in the front slits 2250 for preventing the upward deflection of the contacting section 36. The four first contacts 3 are juxtaposed arranged and the contacting sections 36 thereof are nonelastic. The body section 35 is parallel to the contacting section 36 and is much longer than the contacting section 36.

The additional second set of contacts 4 include two pairs of differential contacts 41 and a grounding contact 42. The two pairs of differential contacts 41 are used for transferring/receiving high-speed signals, and the grounding contact 42 is disposed between the two pairs of differential contacts 41 for preventing cross-talk. Each second contact 4 comprises a middle L-shape retention portion 44 an elastic contact portion 43 extending forwardly from front section of the retention portion 44 and formed with an elastic contacting end 430 curved upwardly, and a tail portion 45 extending rearwardly from rear section of the retention portion 44 and formed with a connecting end 450 curved downward. The second contacts 4 are insertmolded with the insert 9 when forming the insert 9 with the retention portion's 44 interferentially embedded in the insert 9, the front and rear contact portion 43 and tail portion 45 exposed beyond front and rear surfaces of the insert 9. Then, the insert 9 together with the second contacts 4 are assembled to the insulative housing 2 along rear-to-front direction. The insert 9 is received in the accommodating space 2115 with ribs 91 thereon abutting against inner surfaces of the accommodating space 2115 to enhancing the retention effect between the insert 9 and the insulative housing 2. The contact portions 443 are received in the second passages 224 with the contacting ends 430 exposed beyond the first supporting surface 221 of the tongue portion 22. The tail portions 45 are exposed into the terminating space 2122 to be a row above the tail sections 350 of the first contacts 3. Thus, the differential contacts 41 and the grounding contact 42 are juxtaposed with respect to one another along the front-to-back direction. The contacting sections 36 of the four first set of contacts 31, 32, 33 and 34 occupy a majority of length of the tongue portion 22 along the front-to-rear direction with respect to that of the contact portions 43 of the additional second set of contacts 4. Meanwhile, the tail portions 45 are offset from the tail sections 350 of the first set of contacts 31, 32, 33 and 34 in a height direction perpendicular to the front-to-back direction. The tail portions 45 are located under the tail sections 350 of the first set of contacts 31, 32, 33 and 34 to prevent electrical shorting. Besides, each contact portion 43 is cantilevered received in the second passages 224 and protrudes upwardly beyond the supporting surface 221 so that the contact portion 43 is elastic and deformable when engaging with corresponding contacts of an extension to USB receptacle (not shown). The contact portions 43 and the contacting sections 36 are separated in the front-to-back direction with no portion of them contacting one another.

The extension to USB plug 100 is compatible to existing standard USB receptacle. The geometric profile of the tongue portion 22 is same as that of the standard USB plug within an allowable tolerance. That is, length, width and height of the tongue portion 22 are substantially equal to those of the standard USB plug. An arrangement of the four first set of contacts 31, 32, 33 and 34 is compatible to that of the standard USB receptacle. The four first contacts 31, 32, 33 and 34 are for USB protocol to transmit USB signals. In detail, the four first set of contacts 31, 32, 33 and 34 are for power (VBUS) signal, – data signal, + data signal and grounding, respectively. So now, from assignment of each first contacts standpoint, different terminology are given to each of the four first set of contacts 31, 32, 33 and 34, wherein the first contacts 31, 32, 33 and 34 are respectively named as power contact 31, – data contact 32, + data contact 33 and ground contact 34.

Figure 9:
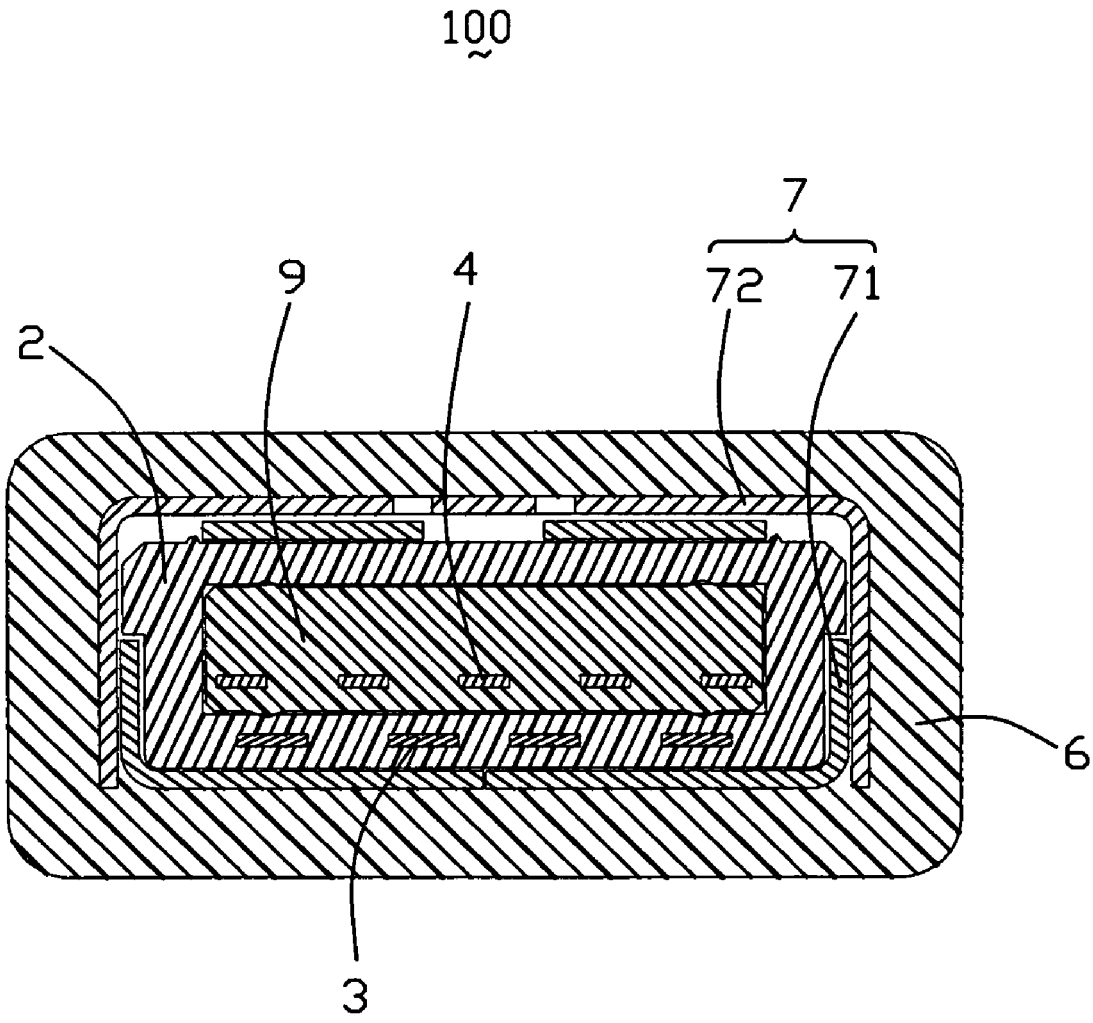
FIGS. 9-11 are cross-section views taken along lines 9-9 and 11-11 of FIG. 8.
Figure 10:
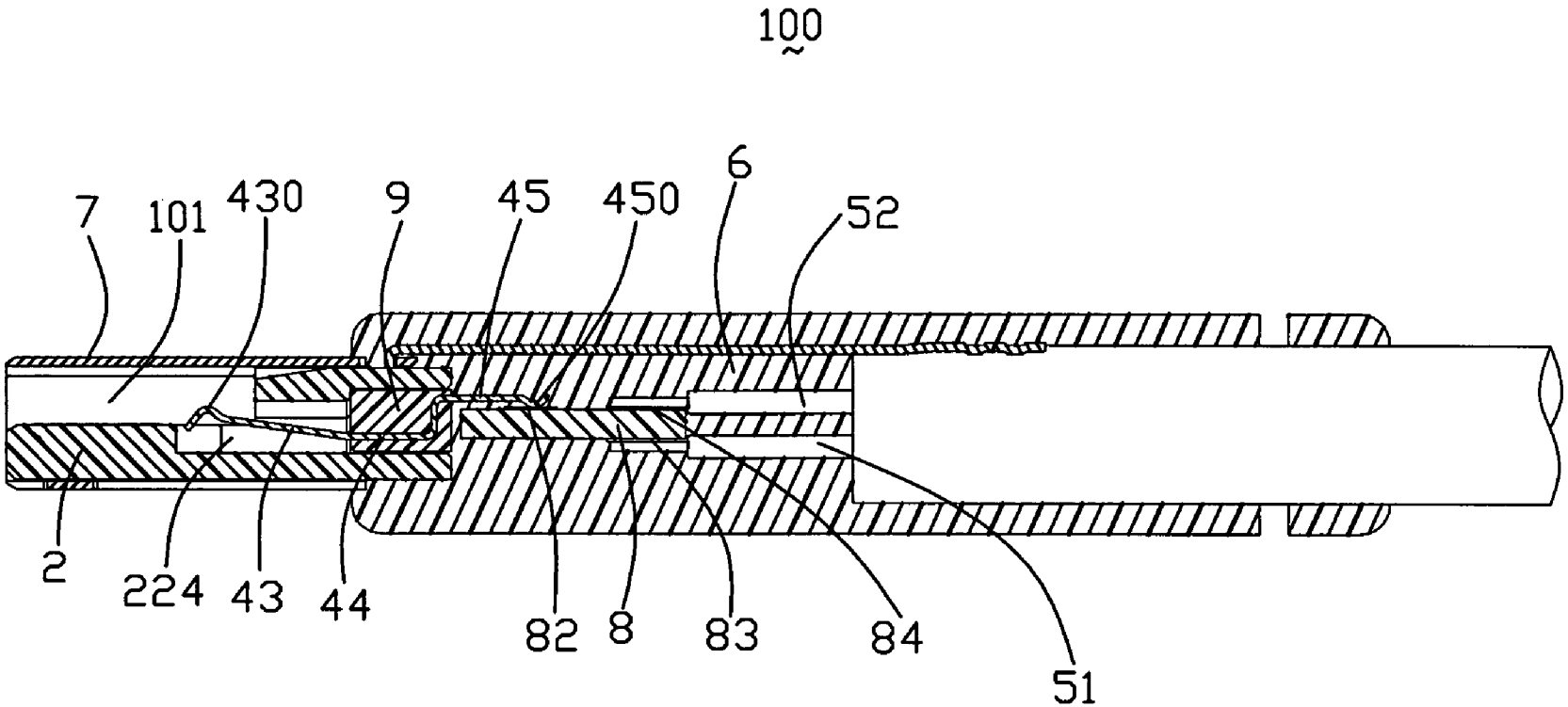
Figure 11:
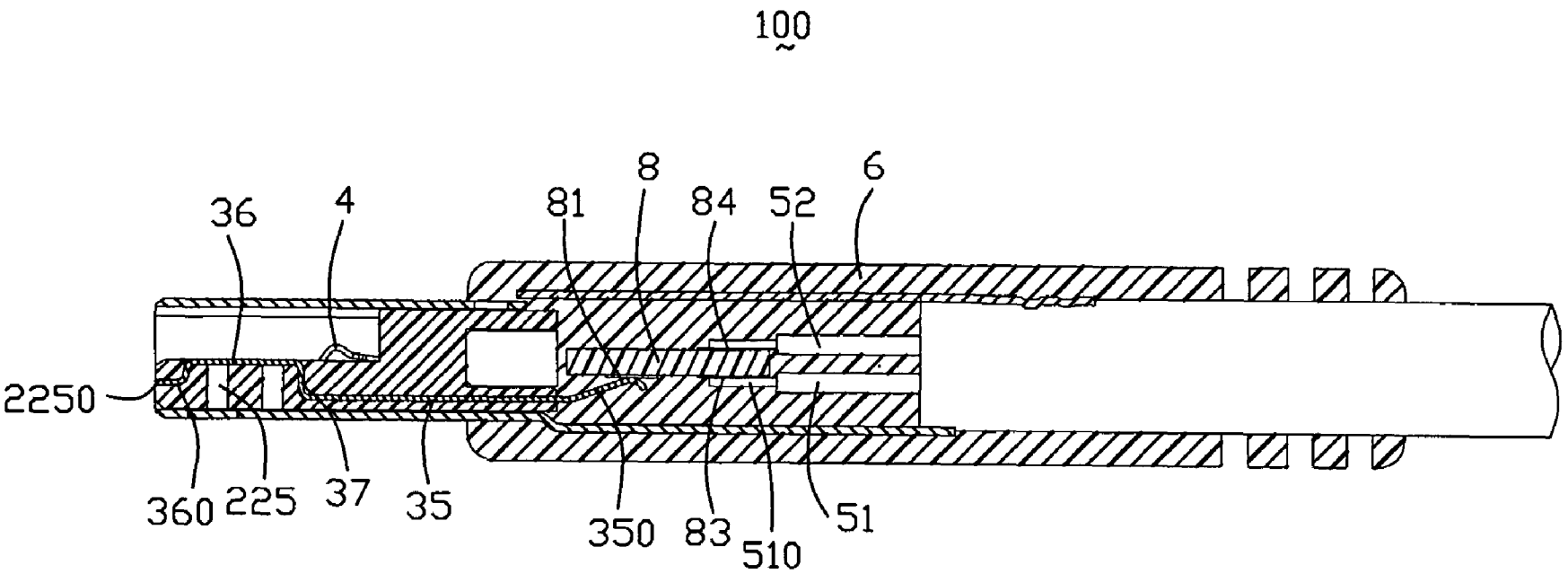

Referring to FIGS. 1-2 in conjunction with FIGS. 9-11, the metal shell 7 comprises a lower first half 71 and an upper second half 72 engaging with the first half 71 to form the whole metal shell 7. The first half 71 comprises a front tube-shape mating frame 710 and a rear U-shape holding section 712 with opposite flanges 7120 each formed with a pair of tubers 7121 bending outwardly for engaging with locking holes 7220 of the second half 72 to secure the first and second halves 71, 72. The front mating frame 710 defines two pairs of rectangular windows 7101 in upper and lower walls thereof and a rear locking opening 7102 in upper wall adjacent to the holding section 712. The second half 72 is assembled to the rear holding section 712 of the first half 71 and comprises a n-shape front holding section 722 and a rear crimping section 721 for grasping the cable 5 to realize strain relief. The holding section 722 forms two pairs of locking holes 7220 in opposite lateral walls thereof and a bending tab 7221 bending from a front edge of upper wall thereof to lock into the locking opening 7102 of the first half 71. After the metal shell 7 is assembled to the insulative housing 2, the contacts 3, 4, and the substrate 8, the mating frame 710 of the metal shell 7 touches other three sides of the tongue portion 22 except the first supporting surface 221, thus, a receiving cavity 101 circumscribed by the mating frame 710 and the first supporting surface 221 is formed. The contacting sections 36 of the first set of contacts 3 and the contact portions 43 of the second set of contacts 4 are all exposed in the receiving cavity 101 for mating with corresponding contact portions of a complementary connector. An arrangement of the metal shell 7 and the tongue portion 22 is also compatible with what of standard USB receptacle.

In the preferred embodiment of the present invention, the first set of contacts 3 are all formed of a metal sheet and separated from one another. It is also to be understood that, in other embodiments, the first contacts 31, 32, 33 and 34 can be conductive pads formed on a printed circuit board which is supported on the supporting surface 221 of the tongue portion 22. These two options to make contacts are both viable in current industry.

The substrate 8 is a flat board with certain thickness. There are four first contact-connecting pads 81 soldered with the first set of contacts 3, and five second wire-connecting pads 84 on front and rear edges of a top surface 80 thereof. There are five second contact-connecting pads 82 soldered with the second set of contacts 4 and four second wire-connecting pads 83 on front and rear edges of a bottom surface 86 thereof.

Figure 6:
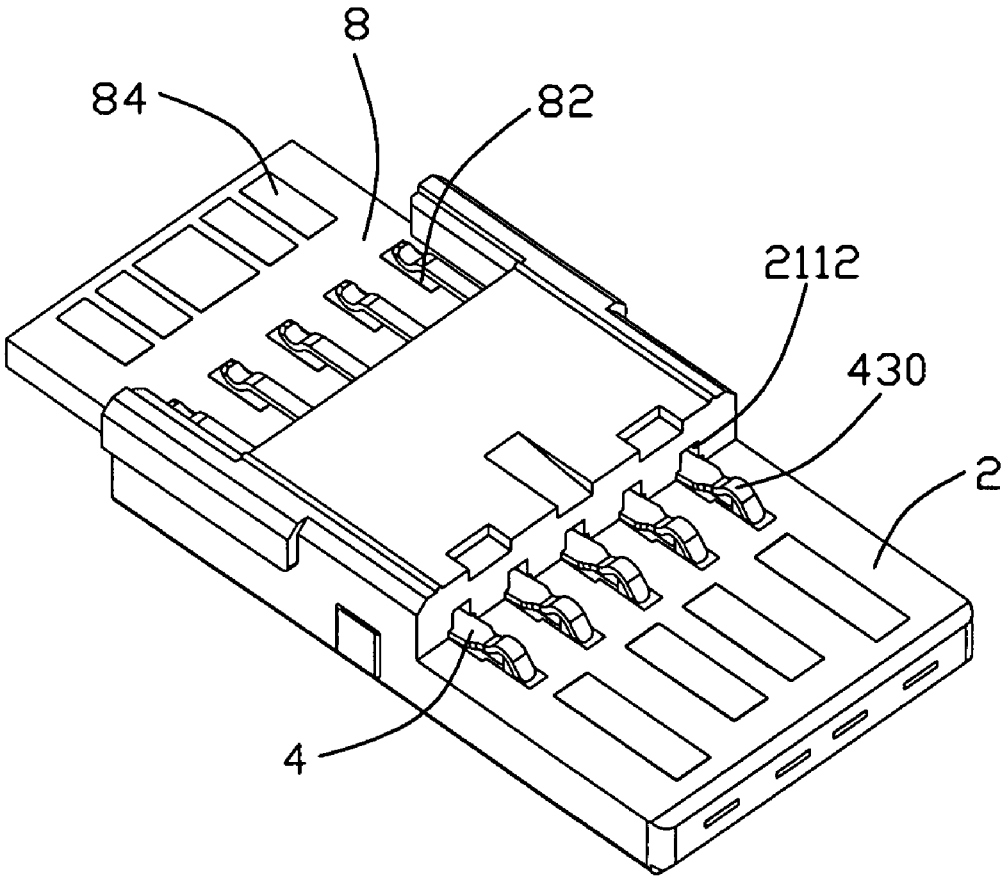
Figure 7:
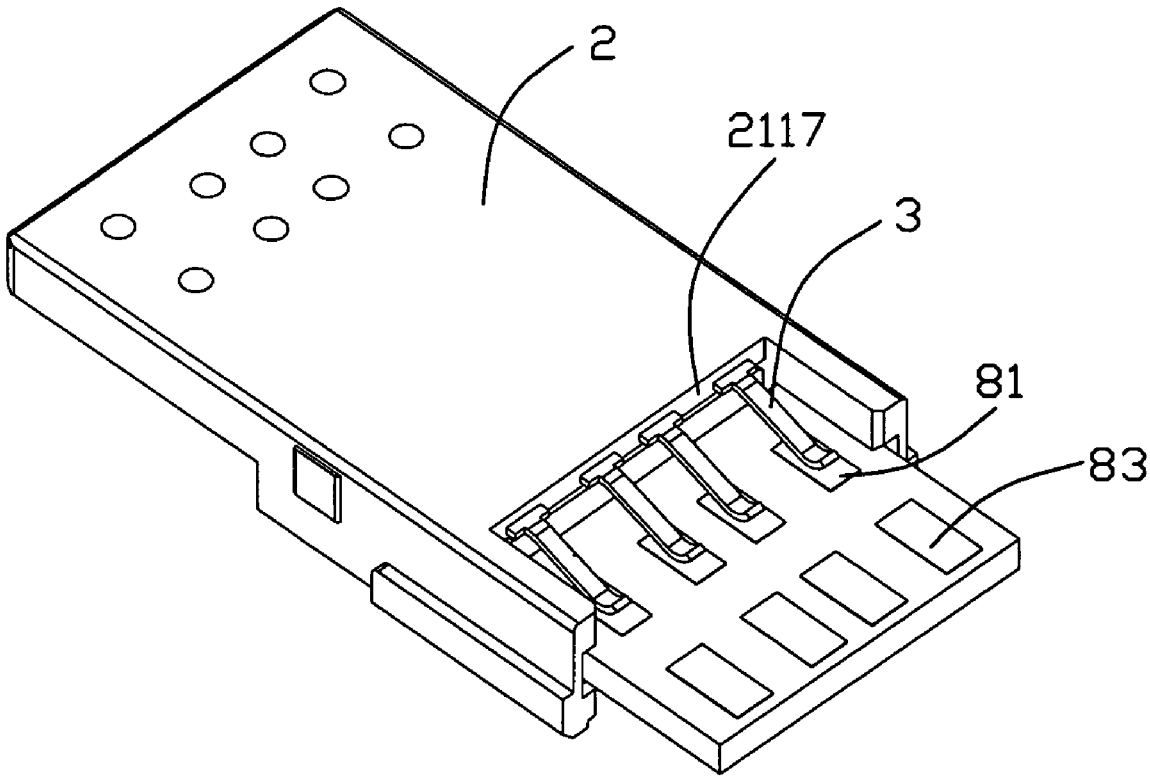
Figure 8:
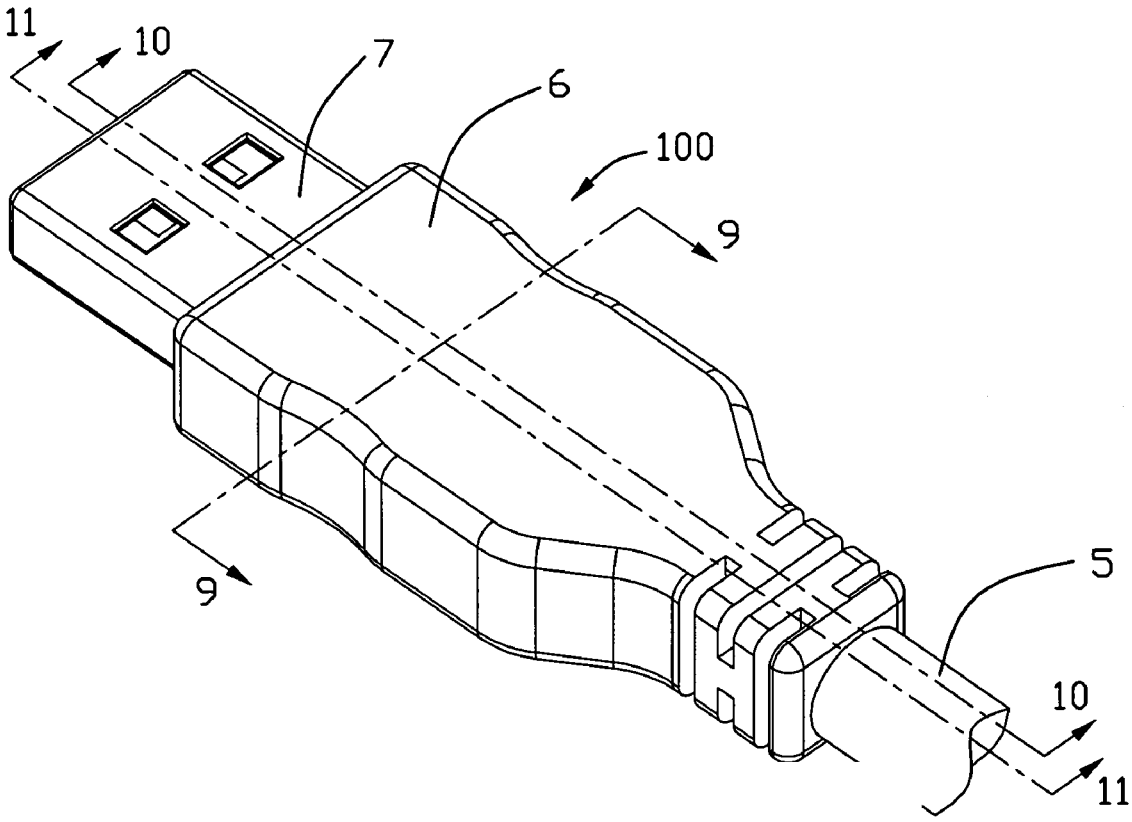
FIG. 8 is an assembled, perspective view of the extension to an electrical connector.

The cable 5 comprises the four first wires 51 arranged in a lower row to be soldered with the four first wire-connecting pads 83 of the substrate 8 to form electrical connection with the first set of contacts 3, and a pair of second wires 52 arranged in an upper row to be soldered with the five second wire-connecting pads 84 to form electrical connection with the second set of contacts 4. Referring to FIGS. 6-7, each first wire 51 comprises an inner conductor 510 soldered with the first wire-connecting pads 83 and an outer jacket 512 enclosing the inner conductor 510. Referring to FIGS. 1-2, the second wires 52 consist of two subassemblies 520. Each subassembly 520 comprises a pair signal wires 521 each having the same structure as that of the first wire 51, a grounding conductor 522 located adjacent to the differential pair 521, and an outer jacket 523 enclosing the differential pair 521 and the grounding conductor 522. The two signal wires 521 of the second wires 52 form a differential pair with reduced crosstalk. The signal wires 521 are soldered to four second wire-connecting pads 84, while the pair of grounding conductors 522 are both soldered to the middle wider wire-connecting pad 84. The metal shell 7 is assembled to the insulative housing 2, the contacts 3, 4, the substrate 8 and the cable 5 as described above. Then, the outer insulative cover 6 is overmolded with the metal shell 7, the cable 5.

Under the non-USB protocol, the two pairs of differential contacts 41 transfer differential signals unidirectionally, one pair for receiving data and the other for transmission data.

In the preferred embodiment of the present invention, the number of the additional second set of contacts 4 is five which consists of two pairs of differential contacts 41 and a grounding contact 42 disposed between each pair of the differential contacts 41 as best shown in FIGS. 1-2 and FIGS. 6-9. However, in alternative embodiments, the additional second set of contacts 4 can only comprise a pair of differential contacts for transmitting/receiving high-speed signals, and if necessarily, a grounding contact can be provided to be positioned on each lateral side of the pair of differential contacts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

I claim:

1. An electrical connector, comprising:

a first housing piece defining a tongue portion defining a mating surface thereon;

a first set of contacts immovably held in the first housing piece, each first contact comprising a nonelastic contact portion exposed on the mating surface of the tongue portion;

a second housing piece assembled to the first housing piece to form an insulative housing;

a second set of contacts immovably held in the second housing piece and comprising at least one pair of differential contacts immovably held in the second housing piece for transferring high-speed signals, and each of the second set of contacts comprising an elastic contact portion exposed on the mating surface of the tongue portion of the first housing piece to be located behind the nonelastic contact portion along the front-to-back direction;

a plurality of first and second wires electrically connecting with the first and second sets of the contacts, and at least two second wires connected to a single second contact;

wherein the first set of contacts is adapted for USB 2.0 protocol and an arrangement of the first set of contacts is compatible to a standard USB 2.0 receptacle, and wherein the pair of differential contacts are adapted for non-USB 2.0 protocol;

a ground conductor located adjacent to the different pair.

2. The electrical connector as claimed in claim 1, further comprising a substrate electrically connecting the contacts and the wires.

3. The electrical connector as claimed in claim 1, further comprising a metal shell enclosing the insulative housing and forms a close receiving cavity together with the mating surface of the tongue portion with the mating portions of the contacts exposed into the receiving space.

4. The electrical connector as claimed in claim 1, wherein the nonelastic contact portions of the first set of contacts are substantially coplanar with the mating surface of the tongue portion, and wherein the elastic contact portions of the second set of contacts are beyond the mating surface.

5. The electrical connector as claimed in claim 1, wherein the geometric profile of the tongue portion is substantially same as that of a standard type-A USB 2.0 plug.

6. The electrical connector as claimed in claim 1, wherein the nonelastic contact portions of the first set of contacts occupy a majority of length of the tongue portion along front-to-back direction with respect to that of the elastic contact portions of the second set of contacts.

7. The electrical connector as claimed in claim 1, wherein an outer jacket enclosing the differential pair and the ground conductor.

8. The electrical connector as claimed in claim 1, wherein the first set of contacts are insertmolded with the first housing piece.

9. The electrical connector as claimed in claim 8, wherein the second set of contacts are insertmolded with the second housing piece.

10. The electrical connector as claimed in claim 1, wherein the first housing piece forms a termination section defining a terminating space and a pair of opposite guiding slots beside the terminating space, and wherein the substrate slides along the guiding slots to be received in the terminating space.

11. The electrical connector as claimed in claim 10, wherein the base portion of the first housing piece defines an accommodating space recessed forwardly therefrom to communicate with the terminating space, and wherein the second housing piece is received in the accommodating space.

12. An electrical connector comprising: a first housing piece defining a tongue portion with a mating surface thereon;

a metal shell enclosing said first housing piece and cooperating with said mating surface to form a mating port, while the other opposite surface of the tongue portion being essentially intimately shielded by said shell;

a second housing piece assembled to the first housing piece and essentially intimately shielded by said shell;

a deflectable first contact immovably held in the second housing piece and extending relative adjacent to said mating surface with a first contacting section exposed upon a rear region mating surface; and a stiff second contact immovably held in the first housing piece and extending relative farther from said mating surface in comparison with said first contact, while with a second contact section deflected to and exposed upon the mating surface;

wherein the first set of contacts is adapted for USB 2.0 protocol and an arrangement of the first set of contacts is compatible to a standard USB 2.0 receptacle, and wherein the pair of differential contacts are adapted for non-USB 2.0 protocol;

a ground conductor located adjacent to the different pair.

13. An electrical connector comprising:

an insulative main housing with a plurality of first contacts embedded therein via an insert molding method;

a terminal module with a plurality of second contacts embedded therein via the insert molding method, assembled to the main housing wherein the second contacts are inserted through corresponding passageways in the main housing and exposed to a same mating face of the main housing with the first contacts;

a printed circuit board sandwiched between tails of the first contacts and those of the second contacts which are mounted on two opposite surfaces thereon; and a first set of cables and a second set of cables connected to the printed circuit board to electrically connect to said first contacts and said second contacts;

wherein the first set of contacts is adapted for USB 2.0 protocol and an arrangement of the first set of contacts is compatible to a standard USB 2.0 receptacle, and wherein the pair of differential contacts are adapted for non-USB 2.0 protocol;

a ground conductor located adjacent to the different pair.

14. The connector as claimed in claim 13, wherein the first set of cables and the second set of cables are mounted upon said opposite surfaces.

15. The connector as claimed in claim 14, wherein the first set of cables are mounted to the surface opposite to the one the tails of the first contacts are mounted, and the second set of cables are mounted to the surface opposite to the one the tails of the second contacts are mounted.

* * * * *